US007073363B2

(12) United States Patent
Hergemöller

(10) Patent No.: US 7,073,363 B2
(45) Date of Patent: Jul. 11, 2006

(54) METHOD FOR PROCESSING DRAWN MATERIAL AND DRAWN MATERIAL PRODUCTION INSTALLATION

(75) Inventor: Rainer Hergemöller, Aachen (DE)

(73) Assignee: Schumag AG, Aachen (DE)

( * ) Notice: Subject to any disclaimer, the term of this patent is extended or adjusted under 35 U.S.C. 154(b) by 39 days.

(21) Appl. No.: 10/849,281

(22) Filed: May 19, 2004

(65) Prior Publication Data

US 2005/0016244 A1 Jan. 27, 2005

(30) Foreign Application Priority Data

May 20, 2003 (DE) ..... 103 23 108
Nov. 24, 2003 (DE) ..... 103 55 090

(51) Int. Cl.
*B21C 1/32* (2006.01)

(52) U.S. Cl. ..... 72/278; 72/286; 72/287

(58) Field of Classification Search ..... 72/278, 72/280, 282, 286, 287, 289
See application file for complete search history.

(56) References Cited

U.S. PATENT DOCUMENTS

| | | | | | |
|---|---|---|---|---|---|
| 1,338,453 | A | * | 4/1920 | Johnson | 72/43 |
| 1,474,778 | A | * | 11/1923 | Johnson et al. | 72/161 |
| 2,138,201 | A | * | 11/1938 | Whittaker | 72/280 |
| 2,348,595 | A | * | 5/1944 | Bletso et al. | 72/66 |
| 2,511,274 | A | * | 6/1950 | Kramer | 140/1 |
| 2,702,937 | A | * | 3/1955 | Smart | 72/40 |
| 4,879,892 | A | * | 11/1989 | Paraskevas | 72/290 |
| 5,855,136 | A | * | 1/1999 | Hausler et al. | 72/291 |
| 5,927,131 | A | | 7/1999 | Kiuchi et al. | |

FOREIGN PATENT DOCUMENTS

| | | |
|---|---|---|
| DE | 26 35 437 | 10/1977 |
| DE | 44 43 736 | 7/1996 |
| EP | 0 036 410 | 6/1984 |

* cited by examiner

*Primary Examiner*—Daniel C. Crane
(74) *Attorney, Agent, or Firm*—Collard & Roe, P.C.

(57) ABSTRACT

In order to increase safety with regard to methods for processing drawn materials, the invention proposes a method for processing drawn materials, especially rod- and tube-shaped metal drawn materials in which the drawn material is drawn through drawing dies using a multi-stage drawing unit and the drawn material is supplied continuously to a final production stage after leaving the multi-stage drawing unit.

9 Claims, 4 Drawing Sheets

METHOD FOR PROCESSING DRAWN MATERIAL AND DRAWN MATERIAL PRODUCTION INSTALLATION

Figure 1:
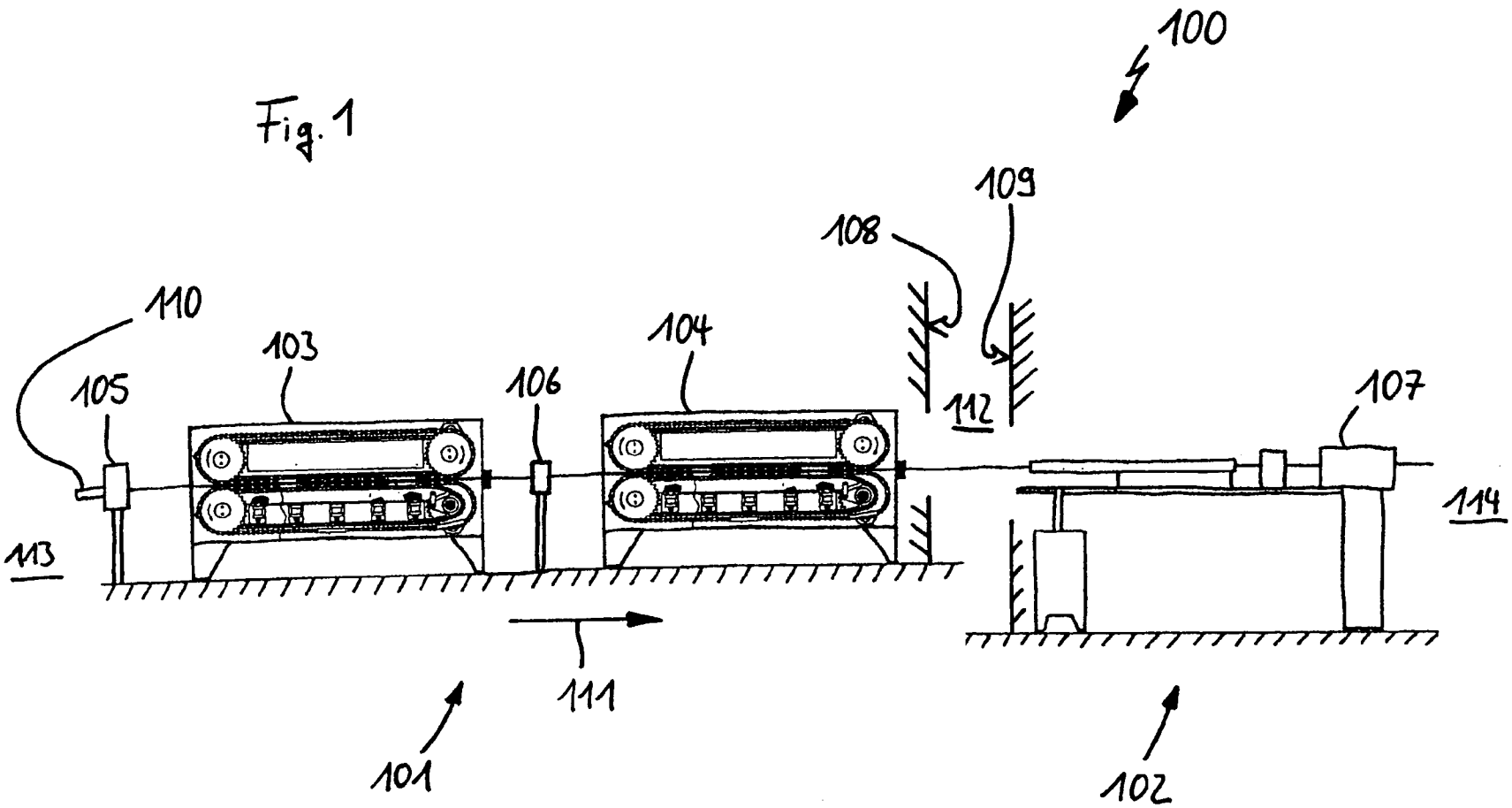

The invention firstly relates to a method for processing drawn material, especially rod- and tube-shaped metal drawn material in which the drawn material is drawn by means a multi-stage drawing unit through one drawing die at a time. The invention secondly relates to a drawn material production installation with a multi-stage drawing unit and at least one final production stage.

Both methods and drawn material production installations for processing drawn material are sufficiently known from the prior art. In the known methods and drawn material production lines a semi-finished product is drawn by means of one or a plurality of drawing devices through one drawing die or a plurality of drawing dies and hereby brought into a desired shape. On passage through the drawing die, the drawn material is suitably reshaped as a result of the forces applied by the drawing device. In this case, the drawing devices respectively transfer a principal drawing force to the drawn material which is selected to be so high that the drawn material is drawn through the respective drawing die by means of a drawing device such that the required deformability can be provided. The drawn material is then usually wound in baskets and prepared for further processing in a final production stage. Since almost all mechanised working processes in the known production lines can be carried out at enormous speeds, a drawn material production line is particularly liable to breakdown, especially with regard to interfaces between the individual processing devices in which the drawn material undergoes different working processes. This particularly applies to those regions in which individual processing speeds vary substantially with respect to one another since a uniform processing flow of the drawn material in the drawn material production line is hereby prevented. For this reason in particular, breakdowns in the production sequence frequently occur whereby the risk of an accident in the area of these interfaces is particularly high. In drawn material production lines in which the semi-finished product is drawn through a plurality of suitable drawing dies by means of a plurality of drawing devices, particularly high transportation speeds of the semi-finished product are achieved. As a result, such drawn material production lines are particularly liable to breakdowns during the transition from one drawing device to another processing device.

In addition to drawn material production lines with two or a plurality of drawing devices arranged one after the other, each interacting with a suitable drawing die, drawn material production lines having only one drawing device with which a semi-finished product is drawn through a drawing die are also known. For example, European Patent Specification EP 0 036 410 B1 and the German Unexamined Laid-Open Patent Publication DE 26 35 437 A1 describe an installation for processing, such as descaling, stamping and/or drawing and subsequently straightening wire in which a high tensile force required for a first processing device implemented in this publication as a drawing die for example, is applied by a motor-driven capstan wound with a plurality of wire turns as drawing device. In this case, the essential principal tensile force is transferred to the capstan so that the wire is transported by this principal tensile force through at least one processing device of the drawn material production line. A pair of driving rolls is provided after the capstan such that the wire is then supplied safely to a straightening device. As a result of the possibility selected here for transporting a wire by means of the capstan through a first processing device in the drawn material production installation, it is achieved that the pair of driving rolls additionally provided to safely supply the wire to another processing device merely needs to transfer small guide forces to the wire so that the risk of a slippage between the pair of driving rolls and the wire to be drawn is substantially reduced. Both the capstan and also the pair of driving rolls are driven by a single drive motor.

Furthermore, a method is known from Patent Specification U.S. Pat. No. 5,927,131 in which a wire coated with a copper layer is freed from the copper plating surrounding the wire by, among other things, a drawing process using a drawing die not explained in detail and the wire from which the copper plating has been removed is supplied to a wire saw. In order to first completely separate the copper plating from the wire, the wire additionally passes through chemical and physical processing processes. In this case, the wire to be processed is unwound from a preparation roll and guided through the processing installation over a plurality of deflecting rolls before being then wound onto an end coil.

The wire wound onto the end coil and from which the copper plating has been removed is then prepared for processing on a wire saw. In order to guide the wire safely through the processing installation, one of the deflecting rolls and the end coil is provided with motors so that the wire is transported through individual areas of the wire plating-removal installation at a pre-determined speed.

It is the object of the present invention to increase the productivity of known drawn material production lines whilst maintaining the same safety or to achieve greater safety at the same productivity.

The object of the invention is solved firstly by a method for processing drawn material, especially rod and tube-shaped metal drawn material, in which the drawn material is drawn through a plurality of drawing dies using a multi-stage drawing unit, the multi-stage drawing unit comprises at least two drawing devices each arranged after a drawing die, which each introduce a principal drawing force into the drawn material in order to draw this respectively through the drawing die mounted before the respective drawing device and the drawn material is supplied continuously to a final production stage after leaving the multi-stage drawing unit.

In this respect, according to the method according to the invention, the drawn material is first subjected to two drawing processes directly after one another, wherein it is initially drawn by a first drawing device through a first drawing die and then continuously by a second drawing device through a second drawing die before then being supplied continuously to a final production process. Thus, the method according to the invention differs from the prior art on the one hand with regard to installations with multi-stage drawing units in that the drawn material is supplied continuously to a final production stage and on the other hand, with regard to installations with a single-stage drawing unit and a final production stage continuously incorporated thereafter in that the drawn material passes continuously through a multi-stage drawing unit. In this case, the operating safety is increased by the method according to the invention compared with the former prior art in that intermediate storage in baskets implemented at high speeds, from which the drawn material may well escape, is avoided whilst the productivity is enhanced because the braking and acceleration processes in these baskets are avoided. The same applies to the latter prior art if the drawn material is first subjected to a separate, separated pre-drawing step. On the other hand, if an attempt is made to increase the productivity in the latter prior art by higher drawing speeds, narrow limits are imposed thereon as a result of the flow limits of the drawn material, the necessary tensile forces and the possible performance of the drawing device as a result of which the operating safety especially is again endangered or reduced.

The continuous supply of drawn material from the multistage drawing unit to the final production stage specifically means that substantially fewer interfaces are present between different processing zones and individual processing devices on a drawn material production installation than was conventionally the case. As a result, the present method for processing drawn material and thus also the entire drawn material production installation is substantially less liable to breakdown and safer in operation. At the same time, the risk of accident is thus reduced so that work involving the drawing of drawn material by the method according to the invention is generally arranged substantially more safely.

In the present case, a multi-stage drawing unit is understood as a plurality of drawing devices connected in series. In this case, preferably either at least two or a plurality of caterpillar traction devices or two or a plurality of carriage drawing devices are connected in series. Since drawing devices of the same design can be synchronised more easily among one another to a processing speed, a multi-stage drawing unit generally has drawing devices of the same type. However, this does not exclude the fact that different drawing devices, such as a caterpillar traction device for example and a drawing carriage device could be connected in series. Multi-stage drawing units reach extremely high speeds at their output since the drawn material reaches a higher material speed on each passage through a drawing die. Precisely these high speeds result in the aforesaid problems in the prior art.

In order to achieve an optimum drawing result particularly quickly, a drawing die through which the drawn material is drawn is preferably arranged before each drawing device. In particular, if a drawing speed of the drawn material after a drawing die is substantially higher than the drawing speed of the drawn material before the respective drawing die, under certain circumstance it can be advantageous if different designs of drawing devices are arranged one after the other. For example, it can be logical to arrange a caterpillar traction device after a drawing carriage device since higher processing speeds can generally be achieved with a caterpillar traction device compared with an equivalent drawing carriage. Thus, large differences in speed in individual areas of the drawing unit can be bridged structurally in a particularly simple fashion.

The term "drawing device" presently designates a device with which a semi-finished product or a drawn material is transported through the present drawn material production line. In the sense of the invention, the principal tensile force is applied to a drawn material with such a drawing device in order to draw this through a relevant drawing die. It is understood that in addition to such drawing devices one or a plurality of guide or conveying devices can be provided in or on the drawn material production line in order to ensure a safe supply of wire to a further processing device, such as to a straightening device for example within the drawn material production line. In this case, each drawing device is constructed such that each drawing device can independently convey a semi-finished product or drawn material through the relevant drawing die independently of another drawing device, especially a drawing device incorporated thereafter or therebefore. A drawing device in the sense of the invention preferably has an independent drive motor so that one drawing device can be operated self-sufficiently with respect to another drawing device within the present drawn material production installation.

In the present matter the term "final production" comprises any processing devices which can carry out an intermediate production or final production beyond the actual drawing process on the drawn material. For example, the final production stage can have a straightening device, a separating device, a rewinding device or a winding device as well as combinations of these devices.

An "interface" is understood as regions of the drawn material production installation which are located between individual processing areas of the drawn material production installation. For example, the transition region between the drawing unit and the final production embodies one such interface.

The term "continuous supply" is understood in the sense of the invention as the direct supply of the drawn material from the drawing unit to the final production or from one drawing device to the next. In this case, especially at least one section of the material web formed by the drawn material is in motion at every operating time regardless of threading in processes, start-up or holding processes or cases of breakdown. During normal operation the drawn material as a whole is never at rest as would be the case in baskets, on reels or in similar arrangements with which the drawn material would be transported from one part device of the installation to the next.

The drawn material is thus not guided from the drawing unit to the final production "batchwise", for example, in baskets as is conventionally the case but is conveyed "online" from one output of the drawing unit to one input of the final production. In this case, the drawn material is in particular continuously under the control of the installation so that even with fast changes in speed as may occur for example, in the case of an emergency stop, the drawn material is continuously guided and thus under control. The safety can hereby be increased considerably.

Continuous supply has the advantage compared with batchwise supply for example that during processing as a whole the drawn material passes through fewer working processes and thus fewer interfaces in the drawn material production installation and thus the operating safety of the entire process is increased.

In addition, the object of the invention is solved by a drawn material production installation comprising a multistage drawing unit in which the multi-stage drawing unit comprises at least two drawing devices each arranged after a drawing die which each introduce a principal drawing force into the drawn material and comprising at least one final production stage wherein one outlet of the drawing unit is arranged with respect to one inlet of the final production stage such that a drawn material passes directly from the drawing unit outlet to the final production inlet.

The processing method submitted here can be advantageously implemented by means of such a drawn material production installation since the present processing method can be carried out particularly safely especially by a multistage drawing unit with at least two drawing devices operating independently of one another and the relevant drawing dies.

In addition, it is possible to draw a semi-finished product through at least two drawing dies many times without interruption in a continuous treatment process so that the drawn material is supplied to a final production, such as a cutting or separating device for example, directly without intermediate storage.

The processing installation according to EP 0 036 410 B1 mentioned initially with the driven capstan and the pair of driving rolls incorporated thereafter is certainly a processing installation in which two transport means acting separately from one another on the semi-finished product to be processed or on the drawn material to be processed, exert a tensile force on the drawn material. However, only the capstan transfers the principal tensile force to the drawn material, the pairs of driving rolls merely exerting guide forces on the drawn material to ensure secure transport of the drawn material through a straightening device. In addition, both transport means are driven by a common motor so that the transport means and the motor as a whole should be considered to be a drawing device. The fact that the drive device described here merely comprises a single drawing device is already shown in the fact that each transport means by itself is not capable of transporting the drawn material safely through the processing installation.

Even if the transport means were to be driven with separate motors, as described in the prior art mentioned in the present publication with regard to DE 26 35 437 A1, a pair of driving rolls is not to be understood as a drawing device in the sense of the invention since in particular a pair of driving rolls cannot exert any sufficiently large drawing force on a drawn material for transport alone and since this does not interact with a drawing die. The pair of driving rolls described rather takes on guide tasks to supply the drawn material to a processing device and to supply the drawn material safely to a straightening device.

In contrast to the conventionally known method for processing drawn material and drawn material production installations, the essential advantage of the present invention should be seen in the fact that a drawn material is especially drawn through a plurality of drawing dies in an uninterrupted treatment process wherein this takes place at such a speed that the drawing devices are for the first time capable of conveying drawn material so quickly through a drawn material processing installation and processing it so that the processed drawn material is supplied to the final production stage online, wherein the final production stage can ideally be operated at a maximum processing speed.

The term "direct" in the sense of the invention not only describes directly opposite inputs and outputs of the drawing unit but also arrangements or a drawn material production installation in which the output of a drawing unit and the input of a final production stage can be arranged offset with respect to one another. The essence of the term "direct" in the sense of the invention is not primarily to be seen in a measure of distance between two components or assemblies. Rather it is important here that the drawn material is conveyed continuously between an output of the drawing unit and the input of the final production.

Such an arrangement between the output of the drawing unit and the input of the final production stage first makes it possible for the drawn material to be conveyed substantially rectilinearly between the drawing unit and final production stage wherein curved sections are also covered by the definition "rectilinearly" as long as the advance movement of the drawn material is not completely reversed.

Since such a drawn material production installation has substantially fewer interfaces between individual processing regions than is the case with conventional drawn material production lines, the risk of a breakdown as well as the associated risk of accident for the operating staff is substantially reduced. This particularly applies with regard to conventional drawn material production lines in which winding takes place in a basket following a drawing unit.

In addition, the object of the present invention is solved cumulatively or alternatively by a method for processing drawn material, especially rods and tube-shaped metal drawn material in which the drawn material is drawn through a plurality of drawing dies by means of a multi-stage drawing unit and the multi-stage drawing unit comprises at least two drawing devices each arranged after one of the drawing dies and the drawn material is supplied to a final production stage at a temperature above the ambient temperature.

A particularly preferred variant of the method provides that the drawn material is supplied to final production at a temperature above 30° C. or above 80° C., preferably above 100° C.

If the material temperature of the drawn material lies above the ambient temperature, the drawn material can generally be processed with substantially lower processing forces. Advantageously the individual treatment processes are substantially easier to control as a result of the lower processing forces so that the risk of a breakdown during operation and if appropriate endangerment of operating staff is substantially reduced.

In addition, the total energy balance of the entire processing method is improved considerably since for example, the energy which was applied during drawing of the drawn material is utilised substantially better in the form of thermal energy in the subsequent course of the process.

In addition, it is also possible to use smaller-dimensioned tools than conventionally since a heated drawn material can be processed with lower forces.

It is also advantageous that the drawn material which is processed at a temperature above the ambient temperature firstly has substantially better deformation properties and secondly, the risk of cracking, especially on the surface of the drawn material, is substantially reduced. The latter is especially advantageous if the drawn material is wound or coiled during the final production.

Another variant of the method provides that the drawn material is conveyed along a processing section with a principal velocity vector and the principal velocity vector points continuously from a starting region of the drawing unit to an end region of the final production. Advantageously the drawn material or the principal velocity vector of the drawn material runs from the starting region of the drawing unit to the end region of the final production stage without any reverse movement—no reversal of direction of movement of the drawn material, that is no change in the direction of motion of the moving material web—but is substantially only moved in one principal direction. The entire processing method is hereby significantly safer since the processing forces formed in the case of the preferably rectilinearly guided drawn material are substantially in the same direction and thus easily controlled. In addition, a reverse movement also means a significant loss of energy since the drawn material is initially braked and must then be accelerated again in the opposite direction.

The term "processing section" is understood in the present connection as that section on which the drawn material is guided and conveyed from an intake region of the drawing unit to a run-out region of the final production. It is to be understood that in addition to rectilinear guidance, this section can also have guidance which deviates from rectilinear, for example, arc-shaped guidance as long as the drawn material does not pass through any reversal of direction on the way or on the section between the intake region of the drawing unit and the run-out region of the final production.

As already mentioned at the beginning, the multi-stage drawing unit can be composed of different drawing devices. In order that the drawn material production installation can also meet different requirements with regard to the final production of a drawn material, the final production stage can have at least one straightening device and/or at least one separating device. In particular in coordination with a straightening device, an almost linear transition between drawing unit and final production stage is advantageous since the required directional energy can thereby be limited to a minimum.

The drawn material is advantageously directed into the final production stage after leaving the drawing unit and if appropriate cut to length without there being a need for intermediate storage of the drawn material between the drawing unit and the final production stage as is the case in conventional drawn material production lines.

It is to be understood that in addition to a straightening device and/or a separating device, the final production stage can cumulatively or alternatively also have at least one rewinding device and/or at least one winding device.

Further advantages, aims and properties of the present invention are described in detail with reference to the following explanation of the appended drawings in which various drawn material production installations are described as examples.

In the Figures

Figure 2:
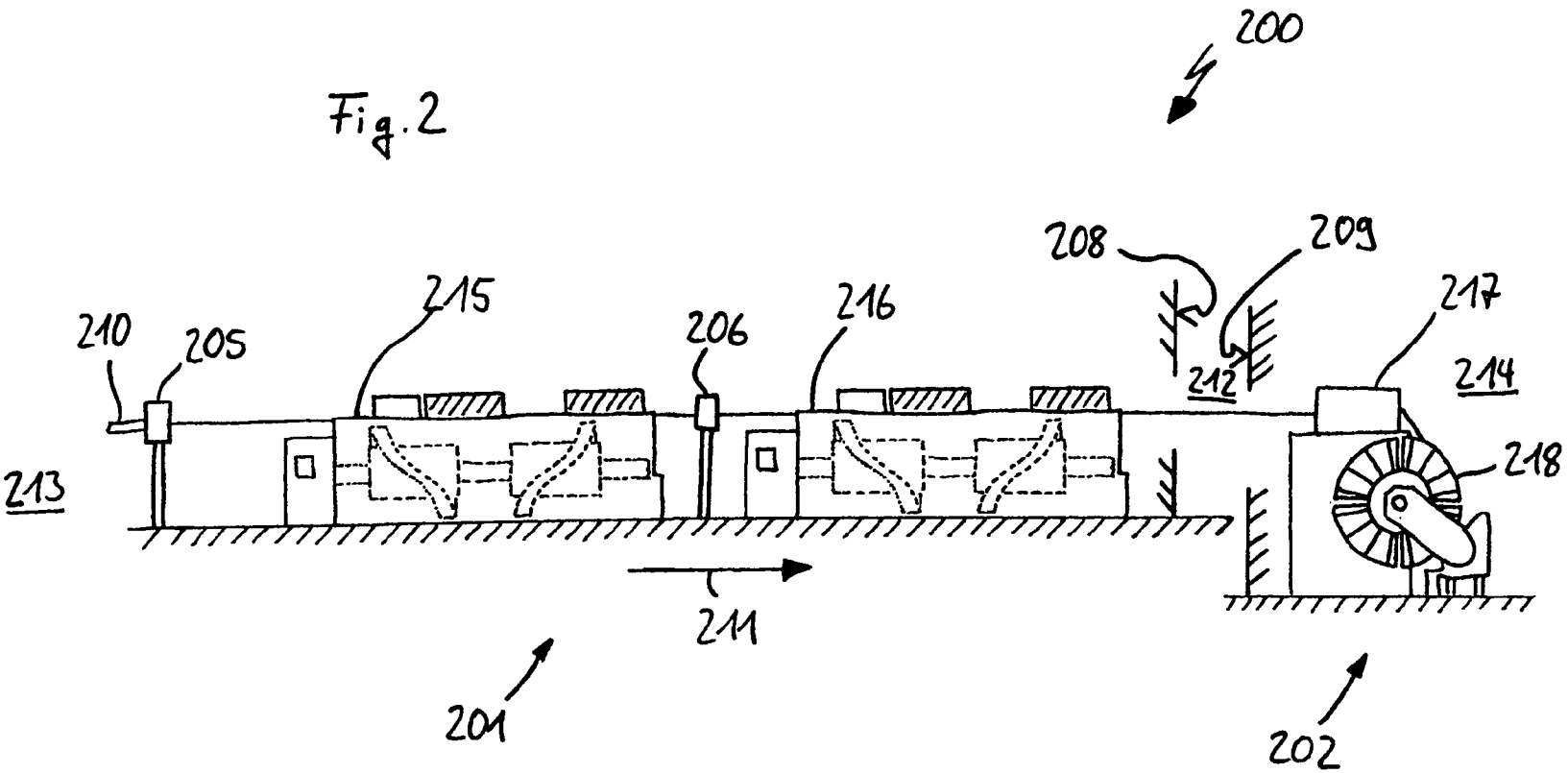
Figure 3:
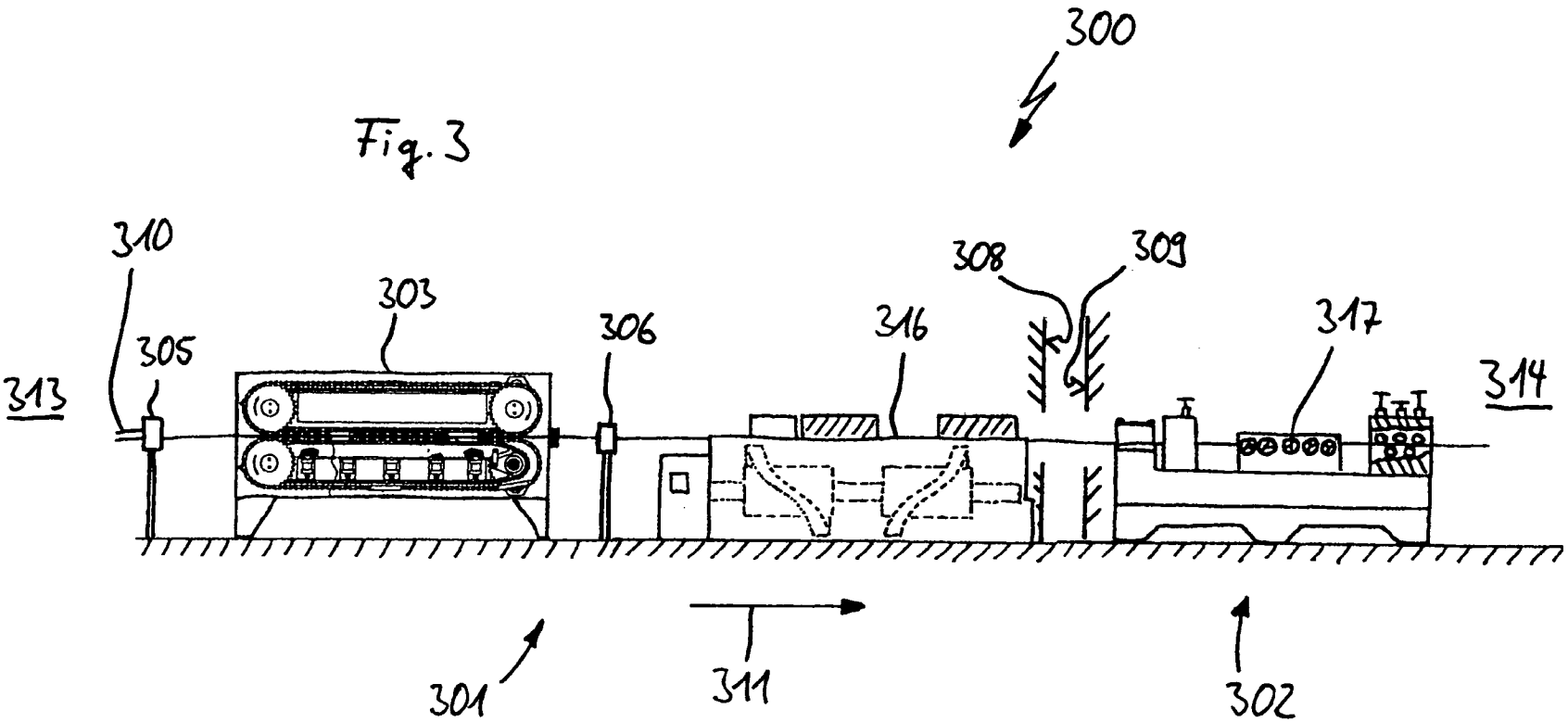
Figure 4:
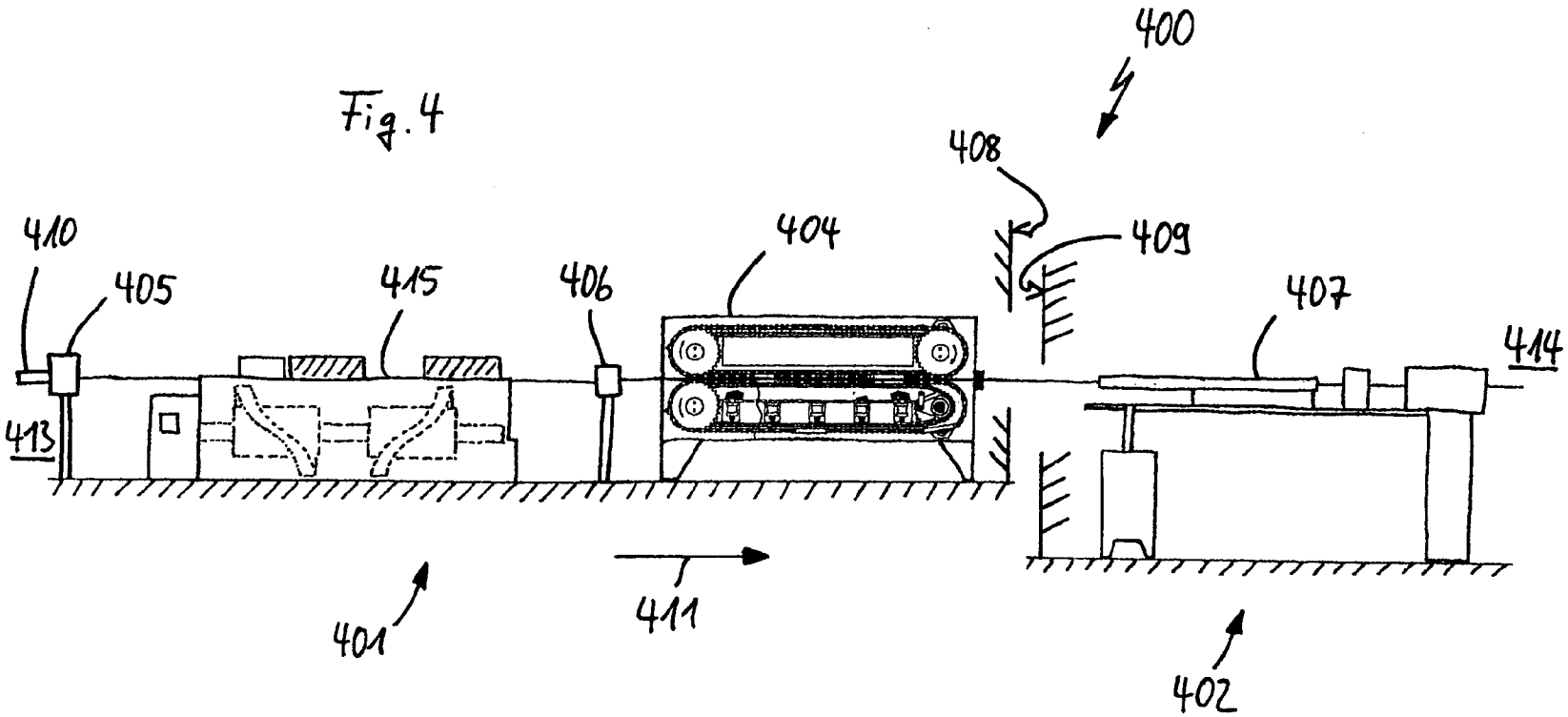

FIG. 1 shows a drawn material production installation with a drawing unit comprising two caterpillar traction devices connected in series and a final production stage with a separating device connected directly thereto, FIG. 2 shows another drawn material production installation with a drawing unit comprising two drawing carriage machines connected in series and a final production stage with a winding device connected directly thereto, FIG. 3 shows another drawn material production installation with a drawing unit comprising a caterpillar traction device and a drawing carriage connected in series and a final production stage with a straightening device connected directly thereto, and FIG. 4 shows a final drawn material production installation with a drawing unit consisting of a drawing carriage and a caterpillar traction device arranged thereafter as well as a final production stage with a separating device connected directly thereto.

The drawn material production installation 100 shown in FIG. 1 substantially consists of a drawing unit 101 and a final production stage 102. The drawing unit 101 consists of two caterpillar traction devices 103 and 104 which are arranged one after the other. A drawing die 105 or 106 is located before each caterpillar traction device 103 and 104. In this exemplary embodiment the final production stage 102 consists of a separating device 107.

The drawing unit 101 and the final production stage 102 of the drawn material production installation 100 are arranged with respect to one another such that an output 108 of the drawing unit 101 and an input 109 of the final production stage 102 lie directly opposite. In this exemplary embodiment the output 108 of the drawing unit 101 and the input 109 of the final production stage 102 are located with respect to one another such that a drawn material 110 which is drawn by both the caterpillar traction devices 103 and 104 towards a processing section 111 through the two drawing dies 105 and 106 is conveyed in a region 112 between the output 108 and the input 109 rectilinearly from the drawing unit 101 to the final production stage 102.

Thus, after leaving the output 108 of the drawing unit 101, the drawn material 110 is supplied online, that is directly and in this exemplary embodiment rectilinearly to the input 109 of the final production stage 102. The drawn material 110 is thereby moved between the drawing unit 101 and the final production stage 102 without any significant change in speed so that the drawn material 110 is processed in the final production stage 102 at the same speed as the drawn material 110 is processed in the drawing unit 101. Advantageously, the drawn material 110 is substantially moved and processed continuously in all regions of the drawn material production installation 100. Compared with the known batchwise processing of a drawn material 110, it is thus possible to talk of "online" processing of the drawn material 110 in the present case.

The conveying direction along the processing section 111 of the drawn material 110 thus in particular from an intake region 113 of the drawing unit 101 to a run-out region 114 of the final production stage 102 undergoes no reversal but is continuously guided in one direction. The conveying direction runs along the processing section 111 from the drawing unit 102 in the direction of the final production stage 102.

Since between the output 108 of the drawing unit 101 and the input 109 of the final production stage 102, no further processing, especially no further considerable mechanical deformation of the drawn material 110 is provided, the drawn material 110 is merely subjected to the essential forming processes from the intake region 113 of the drawing unit 101 as far as the run-out region 114 of the final production stage 102 so that the total processing time is hereby substantially shortened. The faster processing time is mainly attributable to the fact that the drawn material 110 is not supplied batchwise to the final production stage 102 as is known from the prior art but is now supplied online, that is continuously.

In addition, in this way the drawn material is continuously under defined control so that in the event of an emergency stop, for example, the characteristic motion of the drawn material cannot result in breakdowns.

In addition, the high final speed reached by the drawn material when it runs through a multi-stage drawing unit, makes it possible to achieve a particularly effective usage of the final production stage, especially a coil. In particular, the use of precisely a final production stage, especially precisely a winder, for precisely one drawing unit thereby becomes economical.

The drawn material production installation 200 shown in FIG. 2 also principally consists of a drawing unit 201 and a final production stage 202, wherein an output 208 of the drawing unit 201 and an input 209 of the final production 202 also lie directly opposite here. A drawn material 210 is thereby drawn rectilinearly from the drawing unit 201 to the final production stage 202.

In this case, the drawing unit 201 and the final production stage 202 are arranged such that the drawn material 210 is moved from an intake region 213 of the drawing unit 201 to a run-out region 214 of the final production stage 202 rectilinearly along a conveying section 211. In this exemplary embodiment the drawing unit 201 has two series-connected drawing carriage machines 215 and 216 which respectively draw the drawn material 210 through a drawing die 205 and 206. The final production stage 202 has a winder 217 with which the drawn material 210 is wound onto a transport drum 218.

The drawing production installation 300 shown in FIG. 3 consists of a drawing unit 301 and a final production stage 302. The drawing unit 301 has on the one hand a front caterpillar traction device 303 and on the other hand a rear drawing carriage machine 316 as drawing devices. The final production stage 302 has a straightening device 317 and a winder 217 which is not shown but corresponds to the arrangement in FIG. 2. Located both before the front caterpillar traction device 303 and before the rear drawing carriage 316 is respectively one drawing die 305 or a drawing die 306 through which respectively one drawn material 310 is drawn. In this exemplary embodiment the drawing unit 301 and the final production stage 302 are arranged with respect to one another such that an output 308 of the drawing unit 301 and an input 309 of the final production stage 302 lie directly opposite. The drawn material 310 is hereby conveyed continuously and rectilinearly from the drawing unit 301 to the final production stage 302. It is to be understood that relevant, fairly small deviations from a straight line, especially lying within the inherent elasticity of the drawn material, can be provided. In particular, intermediate stores or storage loops or curved material web between drawing carriage machine and final production can be provided since the principal starting point of a continuous principal velocity vector is retained since the drawn material does not change its direction of motion relative to itself, that is, it is not moved to and fro but is merely guided, if appropriate, in a reversal loop or similar.

FIG. 4 shows another drawn material production installation 400 with a drawing unit 401 and a final production stage 402. The drawing unit 401 consists of a front drawing carriage 415 and a caterpillar traction device 404 arranged thereafter. The final production stage 402 comprises a separating device 407 for cutting the drawn material 410 to length.

The combination between first drawing carriage 415 and second caterpillar traction device 404 is in this respect advantageously conceivable since the drawn material 410 must be conveyed after the second drawing die 406 at a higher speed than is the case after the first drawing die 405. Since a caterpillar traction device 404 generally attains higher conveying speeds that a drawing carriage machine 415, such a combination between first drawing carriage machine 415 and a caterpillar traction device 404 located thereafter in series is advantageous insofar as a drawing carriage arrangement is generally cheaper. The drawn material 410 is also conveyed continuously and rectilinearly with respect to the drawn material production installation 400 from the output 408 of the drawing unit 401 to the input 409 of the final production stage 402.

The invention claimed is:

1. A method for processing drawn material (110; 210; 310; 410), especially rod-shaped or tube-shaped metal drawn material, comprising drawing the drawn material through a plurality of drawing dies (105, 106; 205, 206; 305, 306; 405, 406) by means of a multi-stage drawing unit (101; 201; 301; 401) and the multi-stage drawing unit comprises at least two drawing devices (103, 104; 215, 216; 303, 316; 415, 404) each of which comprises a caterpillar traction device and each arranged after one of two drawing dies, which each introduce a principal drawing force into the drawn material in order to draw this respectively through the drawing die mounted before the respective drawing device, and continuously supplying the drawn material to a final production stage (102; 202; 302; 402) directly from and after leaving the outlet of the caterpillar traction device.

2. The method according to claim 1, comprising supplying the drawn material to a final production stage (102; 202; 302; 402) at a temperature above an ambient temperature.

3. The method according to claim 2, comprising supplying the drawn material to a final production stage at a temperature above 30° C.

4. The method according to claim 1, comprising conveying the drawn material with a principal velocity vector (111; 211; 311; 411) along a processing section and the principal velocity vector points continuously from an intake region (113; 213; 313; 413) of the drawing unit to a run-out region (114; 214; 314; 414) of the final production stage.

5. The method according to claim 3, wherein the drawn material is supplied to a final production stage at a temperature above 80° C.

6. The method according to claim 3, wherein the drawn material is supplied to a final production stage at a temperature above 100° C.

7. A drawn material production installation comprising a multi-stage drawing unit (101; 201; 301; 401) in which the multi-stage drawing unit comprises at least two drawing devices (103, 104; 215, 216; 309, 316; 415, 404) each of which comprises a caterpillar traction device and each arranged after a drawing die and comprising a final production stage (102), and wherein an outlet (108; 208; 308; 408) of the drawing unit is arranged with respect to an inlet (109; 209; 309; 409) of the final production stage such that drawn material passes from the drawing unit and directly from the outlet of the caterpillar traction device to the final production stage inlet.

8. The drawn material production installation according to claim 7, wherein the final production stage has at least one straightening device (317) and/or at least one separating device (107).

9. The drawn material production installation according to claim 7, wherein the final production stage has at least one rewinding device and/or at least one winding device (217).

* * * * *